US005413323A

United States Patent [19]

Imbert et al.

[11] Patent Number: 5,413,323

[45] Date of Patent: May 9, 1995

[54] MAIL PROCESSING MACHINE HAVING A MECHANICAL JOGGER WITH ROLLERS

[75] Inventors: Denis Imbert, Valence; Christian Laumond, Chabeuil; Louis Sabatier, Montelier, all of France

[73] Assignee: Compagnie Generale D'Automatisme CGA-HBS, Bretigny-Sur-Orge, France

[21] Appl. No.: 182,508

[22] Filed: Jan. 18, 1994

[30] Foreign Application Priority Data

Jan. 19, 1993 [FR] France ..... 93 00474

[51] Int. Cl.[6] ..... B65H 1/02

[52] U.S. Cl. ..... 271/149; 271/150; 271/105; 271/31.1

[58] Field of Search ..... 271/150, 149, 31.1, 271/105

[56] References Cited

U.S. PATENT DOCUMENTS 2,843,378 7/1958 Faeber .
3,817,516 6/1974 Lazzarotti et al. ..... 271/150
4,595,188 6/1986 Wiley et al. .
4,757,985 7/1988 Hamant et al. ..... 271/149 X

FOREIGN PATENT DOCUMENTS

0295686A1 12/1988 European Pat. Off. .
2373842 7/1978 France .
2903128A1 7/1980 Germany .

*Primary Examiner*—David H. Bollinger
*Attorney, Agent, or Firm*—Sughrue, Mion, Zinn, Macpeak & Seas

[57] ABSTRACT

A machine for processing mail comprises a mechanical jogging device between an unstacking head (3) and a conveyor path (1) for conveying a stack (2) of postal items. The jogging device comprises inclined rollers (8) rotated so that a postal item of the stack, on arriving vertically over the rollers, is capable of dropping edge-on, under the action of gravity, onto the rollers and of being driven towards a jogging margin (7) while simultaneously being moved towards the unstacking head by the effect of the rollers rotating so that its free face comes substantially into contact against the unstacking head.

6 Claims, 2 Drawing Sheets

MAIL PROCESSING MACHINE HAVING A MECHANICAL JOGGER WITH ROLLERS

BACKGROUND OF THE INVENTION

The invention relates to a machine for processing flat articles, and in particular postal items, the machine comprising a conveyor path extending from one of its ends in a substantially horizontal direction to bring a stack of articles standing edge-on towards an unstacking head, an unstacking head close to said end and extending in a substantially vertical direction to unstack a first article from the stack which presents with its free face parallel to the unstacking head, and a mechanical jogging device for jogging at least the first article of the stack prior to unstacking thereof against a jogging margin that extends in a direction substantially perpendicular to the conveyor path and to the unstacking head.

Such a machine is commonly used for sorting a large quantity of postal items. In this type of machine, a jogging device is used since the postal items are not all of the same dimensions and each item to be unstacked must be positioned (with reference to a jogging margin) relative to the unstacking head prior to being unstacked. If such an operation is not performed, two successive postal items may be unstacked simultaneously (double-pickoff phenomenon). To prevent such double-picking-off, the jogging device pushes each item to be unstacked against a reference plane which extends generally transversely to the item that is to be unstacked and which is called the jogging margin.

In a known postal sorting machine, the mechanical jogging device includes a screw having a pitch greater than unity that co-operates with interposed fingers. The screw is installed in line with the conveyor path up to the unstacking head. The items in the stack are pre-separated by the interposed fingers as they travel between the rotating screw threads. The interposed fingers act to form bundles of mail of greater or lesser size along the screw up to the vicinity of the unstacking head. The mail items in the smaller bundles splay out between the interposed fingers and are jogged against the jogging margin by the friction effect where they rub against the outside surface of the screw.

It is necessary to pre-separate the items in the stack prior to jogging in order to ensure that all of the items in the stack are jogged prior to being unstacked by the unstacking head. This function of pre-separating the items in the stack prior to jogging requires the screw to be of substantial length, thus leading to the jogging device being of considerable length. Such a jogging device is also complex. Furthermore, the leading articles in the stack, which articles have been jogged, have the following articles in the stack pressed against them under drive from the screw. This can result in double-pickoff effects when unstacking occurs.

SUMMARY OF THE INVENTION

The object of the invention is to remedy those various drawbacks by proposing a mechanical jogging device that is simpler and less bulky.

To this end, the present invention provides a machine for processing flat articles, characterized in that the jogging device comprises sloping rollers that are rotated, the rollers having mutually parallel axes of rotation that extend downwards from the end of the conveyor path to a bottom portion of the unstacking head, each roller having an upper portion closest to said end of the conveyor path that is offset vertically downwards relative to said end of the conveyor path so that said first article of the stack on arriving vertically above the rollers can drop edge-first under the action of gravity onto the rollers and be driven by friction against the jogging margin while simultaneously being displaced towards the unstacking head.

The advantages obtained by the invention are as follows. Items of mail are pre-separated by each item dropping onto the rollers at the end of the conveyor path. Jogging takes places along the length of the inclined rollers, which length can be relatively short. Consequently, the two functions of pre-separation and of jogging can both be performed in the vicinity of the unstacking head. The mechanical jogging device of the invention is very compact. Since the pre-separated first articles of the stack are not pushed by the stack of items, there is no longer an effect of the first articles having the following articles in the stack pressed up against them. As a result the risks of double-pickoff are reduced.

According to another characteristic of the invention, the jogging device further comprises a support plate that extends in a substantially horizontal direction from the bottom portion of the unstacking head and penetrates between said rollers, said support plate having a width L as measured between the unstacking head and a line of intersection with said rollers that is sufficient to carry a plurality of jogged articles edge-on. Said support plate facilitates the splaying out of the jogged postage items in the vicinity of the unstacking head, thereby enabling the rate of unstacking to be increased.

According to yet another characteristic of the invention, each roller includes a cylindrical portion of gripping material followed by a threaded cylindrical portion, the threaded cylindrical portion being closest to the unstacking head. The presence of thread at the ends of the rollers complementary to the slope of the rollers, makes it possible to further improve the clamping of the bottoms of the postal items in the vicinity of the unstacking head so as to enhance the splaying out of the postal items. Various types of roller may be envisaged to obtain the best possible match with the nature of the postal items to be jogged.

Other characteristics and advantages of the invention appear more clearly on reading the following description of an embodiment of an invention given with reference to the accompanying drawings, in which:

DESCRIPTION OF A PREFERRED EMBODIMENT

Figure 1:
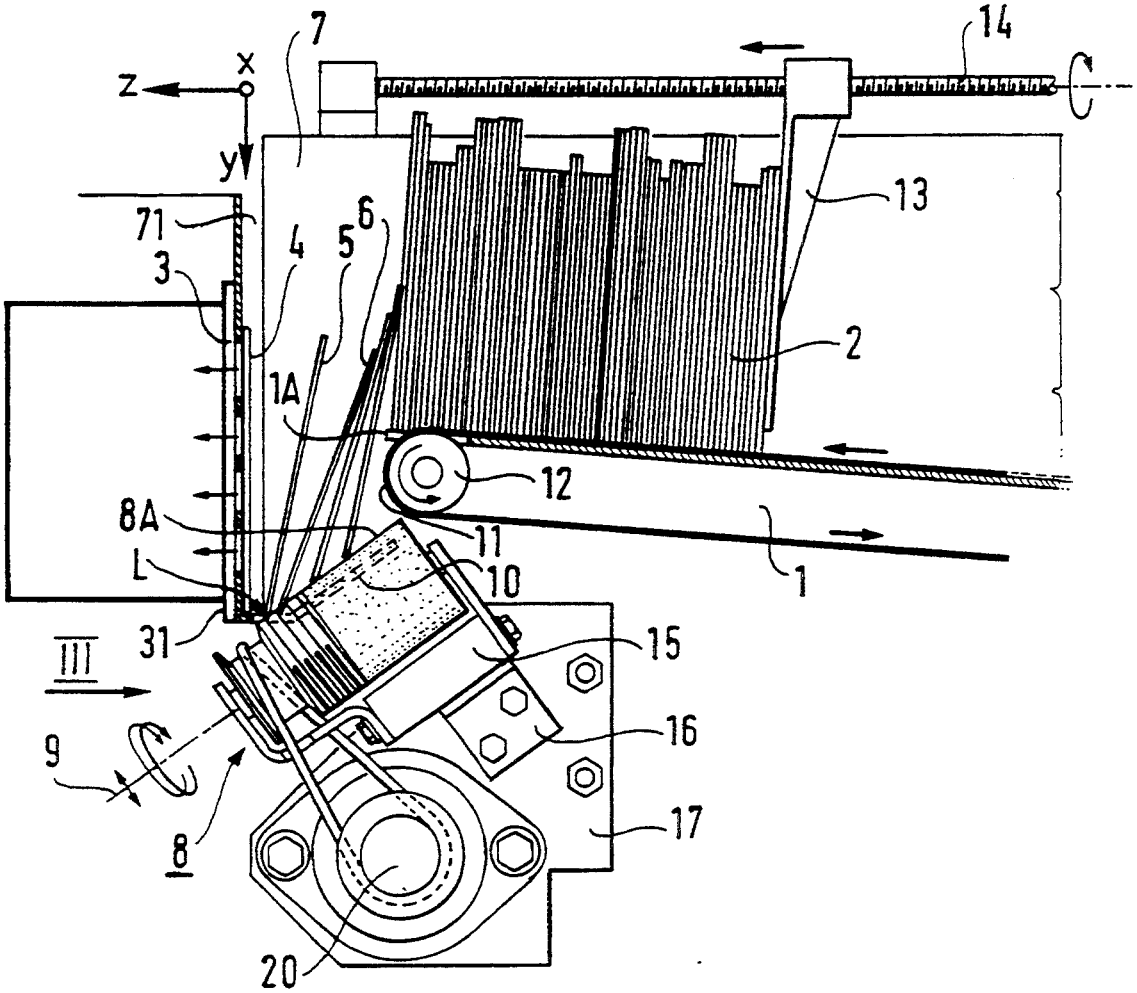
FIG. 1 is a diagrammatic overall view of the machine of the invention.

In FIG. 1, there can be seen a portion of a machine of the invention for processing postal items. It comprises a conveyor path 1 constituted by one or more moving endless belts driven by motorized rollers 12. The belt(s) convey a stack 2 of postal items standing on their edges towards an unstacking head 3. The conveyor path 1 extends from its end 11 closest to the unstacking head 3 in a direction that is substantially horizontal or that slopes slightly relative to a horizontal direction (axis z). In the vicinity of the unstacking head, the conveyor path may slope slightly upwards. A pusher plate 13 is mounted on a rotating worm screw 14 and moves simultaneously with the stack 2 towards the unstacking head, thereby enabling the tail end of the stack to lean against the pusher plate. In this way, the stack of items remains compact throughout its travel towards the unstacking head.

The unstacking head 3 is constituted, for example, by one or more suction nozzles located behind a continuous perforated ejection strip. This suction head 3 extends in a substantially vertical direction (plane xy) and is organized to unstack from the stack 3 each first item of mail 4 that is presented with its free face parallel to and facing the unstacking head.

Figure 3:
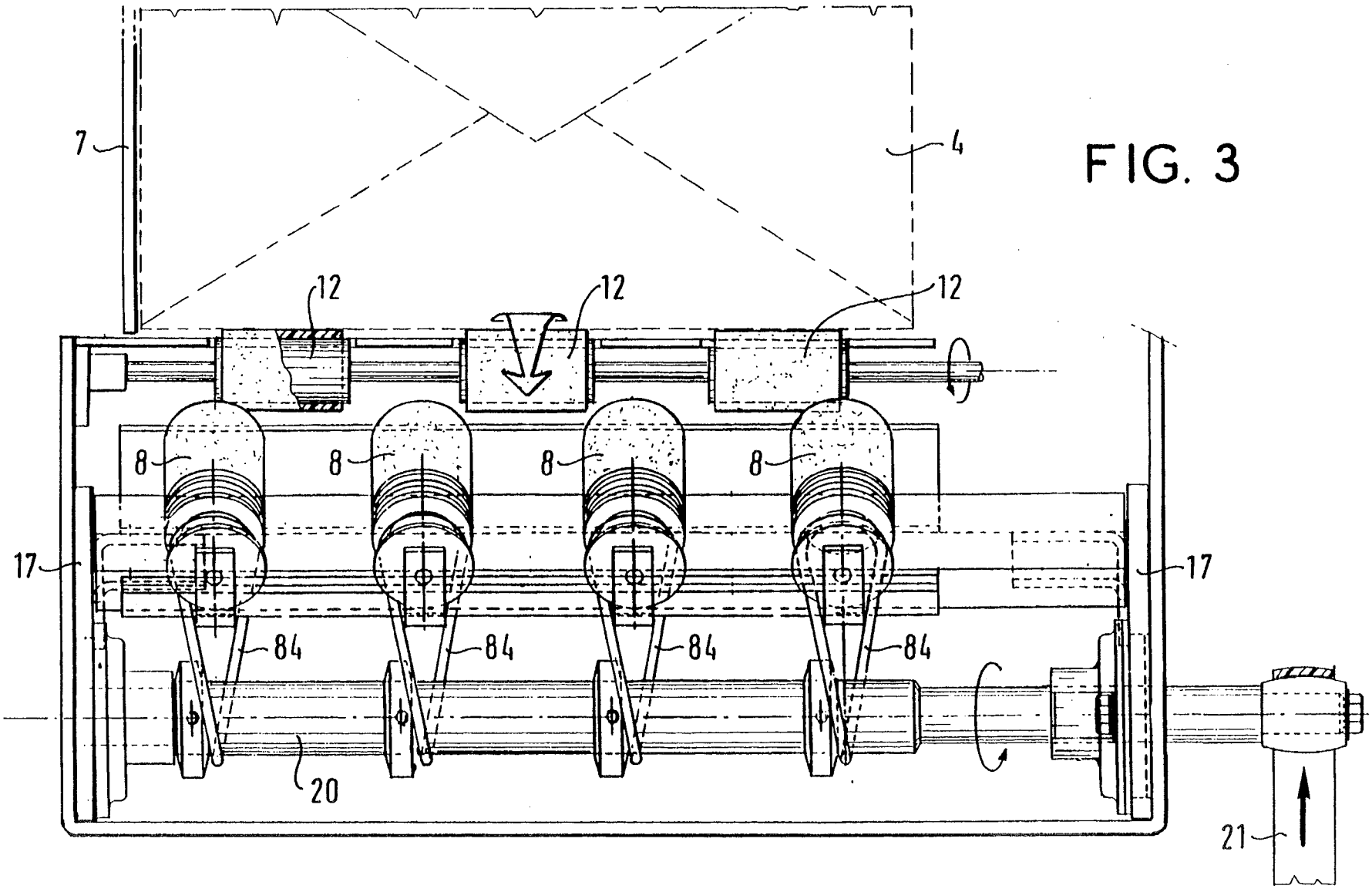
FIG. 3 is a fragmentary diagrammatic view of the machine of FIG. 1 as seen looking along arrow III.

A mechanical jogging device is installed at the end of the conveyor part 1 between the end 11 thereof and the unstacking head 3. This jogging device is constituted by a plurality of rollers 8 each coated with a gripping material, as can be seen in FIG. 3. The rollers 8 are distributed at regular intervals across the width of the conveyor path. As can be seen in FIGS. 1 and 3, they have mutually parallel axes of rotation 9 that slope downwards from the end 11 of the conveyor path towards the bottom portion 31 of the unstacking head 3. The highest portion 8A of each roller that is closest to the end 11 is offset vertically downwards from the end plane 1A of the conveyor path through a distance that is equal to about 50 mm, such that an article in the stack that is moved to overlie the rollers drops under the action of gravity, edge-first, onto the sloping rollers 8 and is thus pre-separated from the stack of postal items 2. In addition, as can be seen in FIG. 1, the bottom portion 31 of the unstacking head 3 is offset vertically downwards relative to the end 11 of the conveyor path 1 so that the angle of inclination between an axis 9 of a roller 8 and the vertical direction (axis y) lies preferably in the range 60° to 50°.

Figure 2:
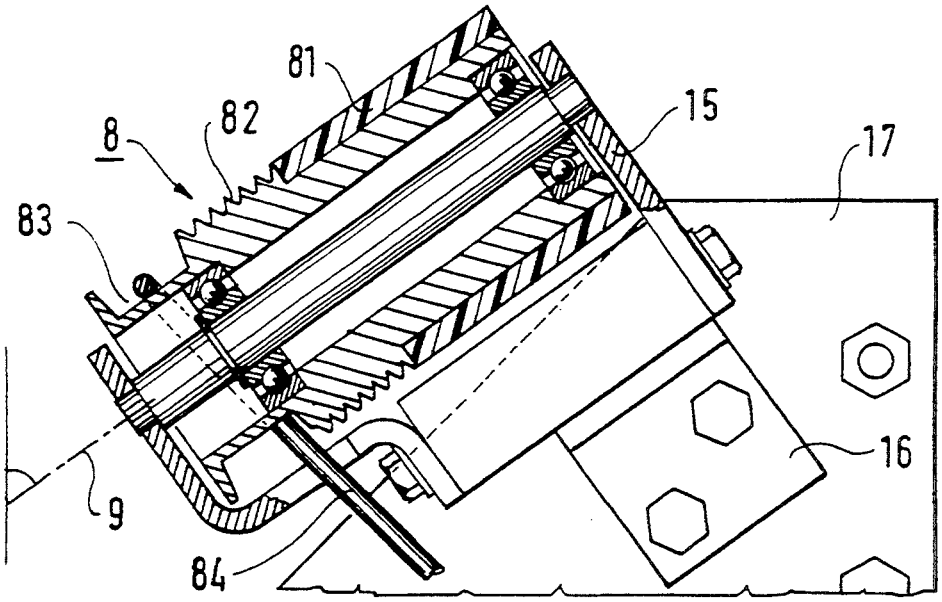
FIG. 2 is an enlarged view in longitudinal section showing a roller of the jogging device of the machine of the invention.

As can be seen in FIG. 2, each roller 8 is mounted to rotate freely on a carrier structure 15. Each carrier structure 15 is itself slidably mounted with a locking option on a strip 16 that extends along the direction of the axis x. The strip 16 is fixed via its two ends to cheek pieces 17 secured to the chassis of the unstacking head or to the chassis of the conveyor path. In this way, it is easy firstly to replace a faulty roller, and secondly to adjust the spacing between the rollers.

Each roller 8 is constituted by a first cylinder 81 coated with a gripping substance, e.g. an elastomer, and preferably polyurethane. A second cylinder 82 extends the cylinder 81. The cylinder 82 has a threaded outside surface. The cylinder 82 is extended by a cylinder 83 that forms a groove in which a belt 84 is received, e.g. a circular section belt (where the cylinder 82 is the closest of the cylinders to the unstacking head). Each belt 84 for each roller is also mounted on a common control shaft 20 that is rotated by a motor (not shown) e.g. via another belt 21 or else via a set of gears. Rotation of the control shaft 20 causes all of the rollers that are connected to said control shaft by respective belts 84 to rotate in the same direction.

According to an aspect of the invention, each roller 8 is mounted so as to be free to rotate on its carrier structure 15 about an eccentric axis 9. When the rollers are rotated by the control shaft, they behave relative to postal items like a vibrator.

A jogging margin 7 is mounted on one of the flanks of the conveyor path, in the vicinity of the unstacking head. As can be seen in FIG. 1, this jogging margin is a plate that extends in a direction that is substantially perpendicular to the conveyor path and to the unstacking head (i.e. in a plane yz) leaving a longitudinal gap 71 between its end closes to the unstacking head and the unstacking head itself. Postal items unstacked by the unstacking head are ejected through this gap.

A support plate 10, e.g. fixed to the chassis of the unstacking head 3, extends in a substantially horizontal direction from the bottom portion 31 of the unstacking head so as to penetrate between the rollers 8, substantially level with the intermediate zone between the cylinder 82 and the cylinder 83 of each roller, after which it rises towards the end 11 of the conveyor path in a direction that is parallel to the axes of rotation 9 of the rollers. As measured between the bottom portion 31 of the unstacking head and a line passing through the intermediate zones, this support plate is of width L sufficient to carry a plurality of postal items edge-on, e.g. eight items. In FIG. 1, only items 4 and 5 are shown standing on said support plate. In addition, this plate prevents objects getting between the rollers.

The jogging device operates as follows. The unstacking head 3 is switched on first, followed by the conveyor path 1, the screw 14, and the rollers 8. The stack 2 of postal items moves towards the unstacking head. A first item 4 in the stack reaches the end 11 of the conveyor path. It drops onto the cylinders 81 of the rollers which, because of their gripping coating, exert lateral friction thrust urging the lateral edge of the item against the jogging margin 7. Because the rollers 8 are inclined, the item moves towards the unstacking head 8 while it is being jogged. During this motion, the item is engaged in the threads of the cylinders 82 of the rollers (the threads being directed towards the jogging margin). The length of a cylinder 82 is about 15 mm. The threads of the cylinders 82 move the bottom of the postal item forwards on the support plate 10 in the vicinity of the bottom portion 31 of the unstacking head. Meanwhile, a second item 5, and then a third item 6 from the stack has dropped onto the rollers 8. As can be seen in FIG. 1, the items 4, 5, and 6 splay apart in the vicinity of the unstacking head 3 under drive from the threaded cylinders 82 of the rollers, while their bottoms are moved towards each other. These jogged items 4, 5, and 6 resting on the horizontal portion of the support plate 10 can be unstacked quickly and in order by the unstacking head 3 since they are suitably separated and jogged. In FIG. 1, item 4 is shown with its front face pressed against the unstacking head, immediately prior to being unstacked. The item 5 will then be pushed against the unstacking head 3 by the bottom of the item 6 so that it is pressed in turn against the unstacking head 3, and so on.

What is claimed is:

1. A machine for processing flat articles, and in particular postal items, the machine comprising: an unstacking head; a conveyor path (1) having one end (11) extending in a substantially horizontal direction to bring a stack (2) of articles (4, 5, 6), standing edge-on, towards said unstacking head, said unstacking head (3) being close to said one end and extending in a substantially vertical direction to unstack from the stack a first article (4) which presents a free face thereof parallel to the unstacking head; and a mechanical jogging device for jogging at least the first article of the stack, prior to unstacking thereof, against a jogging margin (7) that extends in a direction substantially perpendicular to the conveyor path and to the unstacking head; the machine being characterized in that the jogging device comprises:

a plurality of downwardly sloping rotatable rollers (8); and means (20, 84) for rotating said rollers (8);

the rollers having mutually parallel axes of rotation (9) that extend and slope downwards from said horizontal direction and from said one end of the conveyor path to a bottom portion (31) of the unstacking head, each roller having an upper portion that is closest to said one end of the conveyor path and that is offset vertically downwards relative to said one end of the conveyor path so that said first article of the stack, on arriving vertically above the rollers, can drop edge-first under the action of gravity onto the rollers and be driven by friction against the jogging margin while simultaneously being displaced towards the unstacking head.

2. A machine according to claim 1, further comprising a support plate (10) that extends in a substantially horizontal direction from the bottom portion of the unstacking head and penetrates between said rollers, said support plate having a width L, as measured between the unstacking head and a line of intersection with said rollers, that is sufficient to carry a plurality of jogged articles edge-on.

3. A machine according to claim 1, in which each roller (8) includes a cylindrical portion of gripping material (81) followed by a threaded cylindrical portion (82), the threaded cylindrical portion being closest to the unstacking head.

4. A machine according to claim 3, in which the gripping material is a polyurethane elastomer.

5. A machine according to claim 1, in which each roller is mounted to rotate about an eccentric axis (9).

6. A machine according to claim 1, in which the axes of rotation (9) of the rollers slope relative to the vertical direction by an angle lying in the range 60° to 50°.

* * * * *